United States Patent [19]

Rauscher et al.

[11] 4,132,330

[45] Jan. 2, 1979

[54] MOTOR POWERED PASTE DISPENSER

[76] Inventors: Dean C. Rauscher, 684 Greenwood Ave., Devore, Calif. 92407; Robert A. Grozier, 841 E. Mt. View St., Glendora, Calif. 91740; Frank J. Rauscher, 17842 Fairfax Ave., Fontana, Calif. 92335

[21] Appl. No.: 812,728

[22] Filed: Jul. 5, 1977

[51] Int. Cl.[2] ..... B65D 35/34

[52] U.S. Cl. ..... 222/76; 222/100

[58] Field of Search ..... 222/99, 100, 101, 102, 222/333, 76

[56] References Cited

U.S. PATENT DOCUMENTS

| | | | |
|---|---|---|---|
| 2,717,103 | 9/1955 | Hill | 222/100 |
| 2,742,189 | 4/1956 | Morrison | 222/100 |
| 3,198,389 | 8/1965 | Dunning | 222/102 X |
| 3,854,629 | 12/1974 | Blieberger | 222/333 X |
| 3,880,328 | 4/1975 | Leeson | 222/100 |

FOREIGN PATENT DOCUMENTS

| | | | |
|---|---|---|---|
| 954094 | 9/1974 | Canada | 222/102 |

*Primary Examiner*—David A. Scherbel
*Attorney, Agent, or Firm*—Dana E. Keech

[57] ABSTRACT

A plastic-cabinet-confined, battery-energized, electric-motor-powered, push-button-switch-controlled, tube-squeezing paste dispenser which extrudes paste when the push-button is held closed and retracts back into the tube paste dripping therefrom when said push-button is released.

2 Claims, 3 Drawing Figures

NOR gate 1
NOR gate 2
NOR gate 3
.01 UF C1
.05 UF C2
20M R3
33K R1
1.5M R2
100Ω R4
22K R5
22K R6
22K R7
22K R8
2N4126 T1
2N4126 T2
2N4126 T3
2N4126 T4
29
33
34
42
43
44
10
11
12
13
14
15
16
17
18
19
20
25
26
27
28
30
31
32
35
40

MOTOR POWERED PASTE DISPENSER

SUMMARY OF THE INVENTION

It is an object of the invention to provide a simple plastic cabinet confined self-contained device for dispensing as needed any commodity packaged in tube in fluent paste form such as toothpaste and which will deliver paste in response to the actuation of a push-button controlling a battery powered electric motor which is directly connected to the tube by a split shaft and which is retained in normal relation with the axis of the tube by said motor being slideable within said cabinet on a pair of opposed tracks parallel with said tube.

It is another object of the invention to provide such a paste dispensing device including an electronic motor control circuit which enables a DC motor to be driven in one direction while the contacts of a push-button switch are held closed, and which upon the opening of these contacts, after a minimum closure of fifteen milliseconds, will automatically drive the motor in a reverse direction for approximately one second, thereby retracting into said tube any paste dripping from the discharge nipple of said tube.

It is a still further object of the invention to provide such a power driven paste dispensing device which has a thin plastic thread-engaging clip which performs the function of locking the tube to the cabinet of the device while the latter is being employed in dispensing a measured quantity of paste from the tube.

DETAILED DESCRIPTION OF THE PREFERRED EMBODIMENT

Figures 1, 2, 3:
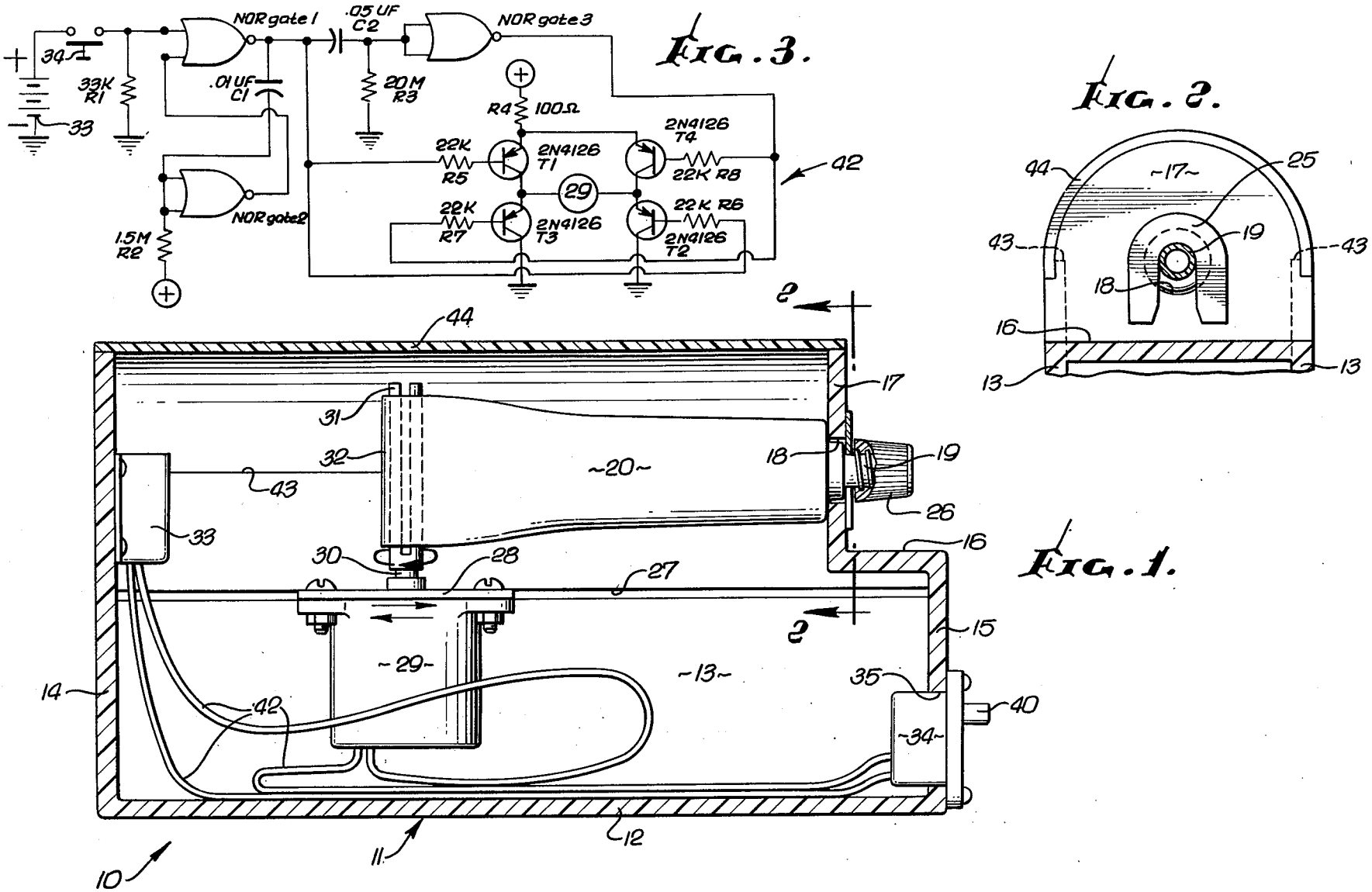
FIG. 1 is a diagrammatic vertical longitudinal sectional view illustrating a preferred embodiment of the invention.
FIG. 2 is a fragmentary detailed sectional view taken on the line 2—2 of FIG. 1 illustrating the tube locking clip of the invention.
FIG. 3 is a diagram illustrating the electronic circuitry of the invention.

The invention comprises a battery operated push-button controlled dispenser of toothpaste 10, which includes a rigid sheet plastic cabinet 11 having a bottom 12, side walls 13 and end walls 14 and 15. Formed at approximately mid point in the wall 15 is a step 16, an upper portion 17 of said end wall being provided with a hole 18 for receiving the threaded dispensing nipple 19 of a flexible tube 20 filled with toothpaste, a plastic clip 25, as shown in FIG. 2, being U-shaped to fit around said nipple and engage the threads provided thereon so that when the cap 26 is removed, the clip 25 will hold the tube 20 rigidly attached to upper portion 17 of end wall 15.

Horizontally opposed internal slots 27 are provided in side walls 13 just below the step 16, said slots forming a pair of tracks in which a rectangular plate 28 is slideably mounted. Suspended from plate 28 is a geared reversible electric motor 29 having a solid vertical driven shaft 30 on which a hollow split shaft 31 is fixed for receiving a flattened closed end portion 32 of a dentifrice tube 20 when this tube is first inserted into the cabinet 11.

A dry battery 33 is mounted on the inner face of wall 14 and a pushbutton switch 34 is mounted in a hole 35 formed in opposite end wall 15, said switch having a push-button 40 extending horizontally therefrom. Dry battery 33, motor 29 and switch 34 are connected by an electronic circuitry 42 so that motor 29 is battery powered to rotate forwardly whenever push-button 40 is depressed and to briefly automatically rotate reversely whenever said pushbutton is released after completing a paste dispensing operation.

Upper end portions of walls 14 and 17 are arcuate and the upper ends of side walls 13 terminate at the level 43 and a correspondingly arched plastic cover 44 snaps downwardly in place to cover the upper end of the plastic cabinet 11 of the invention, the cover 44 being readily removable manually and replaceable with a snapping action when it is necessary to replace a used up dentifrice tube 20 by a fresh tube.

To make such a replacement, the cap 26 of the dentifrice tube is removed and the clip 25 likewise slipped upwardly from its locking relation with the nipple 19 so that the exhausted dentifrice tube 20 and the motor 29 may be shifted to withdraw the nipple 19 from the hole 18 after which the exhausted tube may be slid upwardly off the split hollow shaft 31 and with the motor 29 repositioned in its starting position, a fresh tube 20 of toothpaste may be inserted in the device 10 in the same manner as the original tube is shown in FIG. 1 after it has been so inserted and locked in place by the plastic clip 25.

OPERATION

The electronic circuitry 42 shown diagrammatically in FIG. 3, operates as follows:

An impulse of logic state '1' is fed to NOR gate 1 upon closure of the contacts in the switch 34. Capacitor C1 and resistor R2 form a time constant for the de-bouncing of the input signal along with NOR gate 2. The output from NOR gate 1 is fed through resistors R5 and R6 to transistors T1 and T2 to drive the motor 29 in a forward direction. This condition is maintained until switch 34 is released to open position; whereupon the output of NOR gate 1 then switches and this pulse is fed through capacitor C2 to the input of NOR gate 3. The output of NOR gate 3 is fed through resistors R7 and R8 to transistors T3 and T4 which causes the motor 29 to be driven in a reverse direction. This condition is maintained until resistor R3 has drained sufficient voltage off of capacitor C2 and therefore diminishing the input to NOR gate 3 to change the output state of this gate back to logic '1' and thereby stop the motor 29.

We claim:

1. In a device for dispensing a fluent paste confined in a flexible tube sealed shut at one end, through a nipple provided at its opposite end, the combination of:

electromotive means for applying torque to said shut end of said tube about a transverse axis to wind up said tube and to extrude paste from said nipple;

a solid state electronic circuitry for controlling said electromotive means;

a single on-and-off push button switch means which, when actuated, to turn it on, functions through said circuity to cause said electromotive means to wind-up on said tube to extrude paste from said nipple, said switch being turned off immediately when released whereupon said circuity automatically functions to reverse said electromotive means to relax said rotary winding on said tube for a brief period, to draw back into said nipple, paste left hanging therefrom when said switch is released, said electromotive means including a battery powered reversible DC motor having a gear driven shaft;

split shaft means co-axially fixed on and driven by said motor shaft and engaging said shut end of said paste filled tube so as to wind said tube on said shaft while said nipple is uncovered and said motor is positively energized, thereby dispensing paste from said nipple;

cabinet means for immobilizing said nipple while guiding said motor for free movement directly towards and away from said nipple during the operation of said device;

said cabinet means having an end wall, side walls, and a pair of guide tracks formed in parallel opposing relation on the inner faces of said side walls;

means for mounting said nipple of a dentifrice paste confining tube in said end wall to extend outwardly through said wall and be fixed therein with said tube disposed in parallelism with and equidistant from said tracks; and platform means slideably interlocking with said tracks and having said motor mounted thereon to guide said motor with said tube winding shaft of said motor intersecting the lengthwise axis of said tube and winding said tube on said shaft to extrude paste from said nozzle while said switch is being actuated.

2. A combination as recited in claim 1 wherein the means for mounting said dentifrice tube on said end wall of the cabinet includes the provision of a hole in said wall through which the threaded dentifrice dispensing nipple of the tube may be inserted after the cap has been removed therefrom; and a flat plastic clip having a generally U-shaped conformation and readily applicable to said threaded paste dispensing nipple so as to grip the same and mount said tube firmly on said cabinet end wall for dispensing paste therefrom ;during the temporary absence from the nipple of the closing cap.

* * * * *